United States Patent [19]

Thalmann

[11] 4,405,132

[45] Sep. 20, 1983

[54] TARGET MEMBER SIMULATING AN OBJECT TO BE FIRED ON

[75] Inventor: Claude Thalmann, Muri, Switzerland

[73] Assignee: Polytronic AG, Muri, Switzerland

[21] Appl. No.: 299,186

[22] Filed: Sep. 3, 1981

[30] Foreign Application Priority Data

Sep. 4, 1980 [CH] Switzerland ..... 6638/80

[51] Int. Cl.[3] ..... F41J 1/00

[52] U.S. Cl. ..... 273/348.1

[58] Field of Search ..... 273/348, 348.1; 434/11

[56] References Cited

U.S. PATENT DOCUMENTS 4,240,212 12/1980 Marshall et al. ..... 273/348 X
4,253,670 3/1981 Moulton et al. ..... 273/348 X
4,260,160 4/1981 Ejnell et al. ..... 273/348 X
4,279,599 7/1981 Marshall et al. ..... 273/348 X
4,303,853 12/1981 Thalmann ..... 273/372 X

*Primary Examiner*—William H. Grieb
*Attorney, Agent, or Firm*—Karl F. Ross

[57] ABSTRACT

A device usable in firearm practice comprises an upright target member with a front surface having selected heat-emitting areas which simulate the thermal signature of a military object. That surface is covered in one instance by two interleaved arrays of conductor strips bridged by short patches of resistance material which act as localized heat generators upon being energized with direct current. In another embodiment the heat-emitting areas are reflectors irradiated by infrared lamps that are disposed in front of the target member below a firing line.

3 Claims, 2 Drawing Figures

TARGET MEMBER SIMULATING AN OBJECT TO BE FIRED ON

FIELD OF THE INVENTION

My present invention relates to a device, used for firearm practice, comprising a member carrying an image which represents the outline or silhouette of a simulated target.

BACKGROUND OF THE INVENTION

It is generally known that military objects to be confronted in combat, e.g. tanks, can be located by observing their infrared-radiation patterns by means of suitable detectors, such as residual-light amplifiers or heat-image cameras, which permit the identification of the thermal signature of each object. The same methods are also used in hunting.

Furthermore, in connection with target practice on a range or in the field, it is known to provide members with images, simulating silhouettes of objects to be confronted, which can be constructed as standing, folding, revolving or moving targets. These targets can be made from diverse materials such as fabric, wood, plastic, metal, etc. and may or may not be provided with a score display. See, for example, commonly owned application Ser. No. 227,769 filed Jan. 23, 1981 by Ferdinand Schärer, now U.S. Pat. No. 4,361,330, as well as my prior U.S. Pat. No. 4,303,853 also owned by the assignee of my present application.

It has already been proposed to use infrared radiation, emitted by a target member, in order to facilitate its detection and the identification of an enemy weapon simulated thereby.

OBJECT OF THE INVENTION

The object of my present invention is to provide simple means for marking selected areas of such a member with a pattern of infrared radiation to simulate the thermal signature of a clearly defined target to be shot at.

SUMMARY OF THE INVENTION

According to one embodiment of my invention, the means for producing the thermal signature can be in the form of a printed circuit. Two interleaved arrays of parallel conductor strips on a front surface of the target member, connected across a power supply, are bridged by a multiplicity of short patches of higher electrical resistance in predetermined heat-generating areas from which significant amounts of infrared radiation are emitted by the Joule effect.

The conductor material should be so chosen that strip portions damaged by a shot can be burned away by an overload current which flows in the restricted path formed by the partly destroyed conductor.

Furthermore, in order to make it possible to use such target members a number of times, it is advantageous if the conductor strips and their resistive patches or bridges are wider than the holes made by the bullets that are fired into them.

According to another embodiment of my invention, the means for producing the thermal signature comprise a multiplicity of heat-emitting areas on the front surface of the target member which are made from more strongly reflecting material than the remainder of that surface and can be exposed to irradiation by heat rays from externally positioned infrared lamps.

BRIEF DESCRIPTION OF THE DRAWING

The above and other features of my invention are described hereinafter with reference to the accompanying drawing wherein.

SPECIFIC DESCRIPTION

Figure 1:
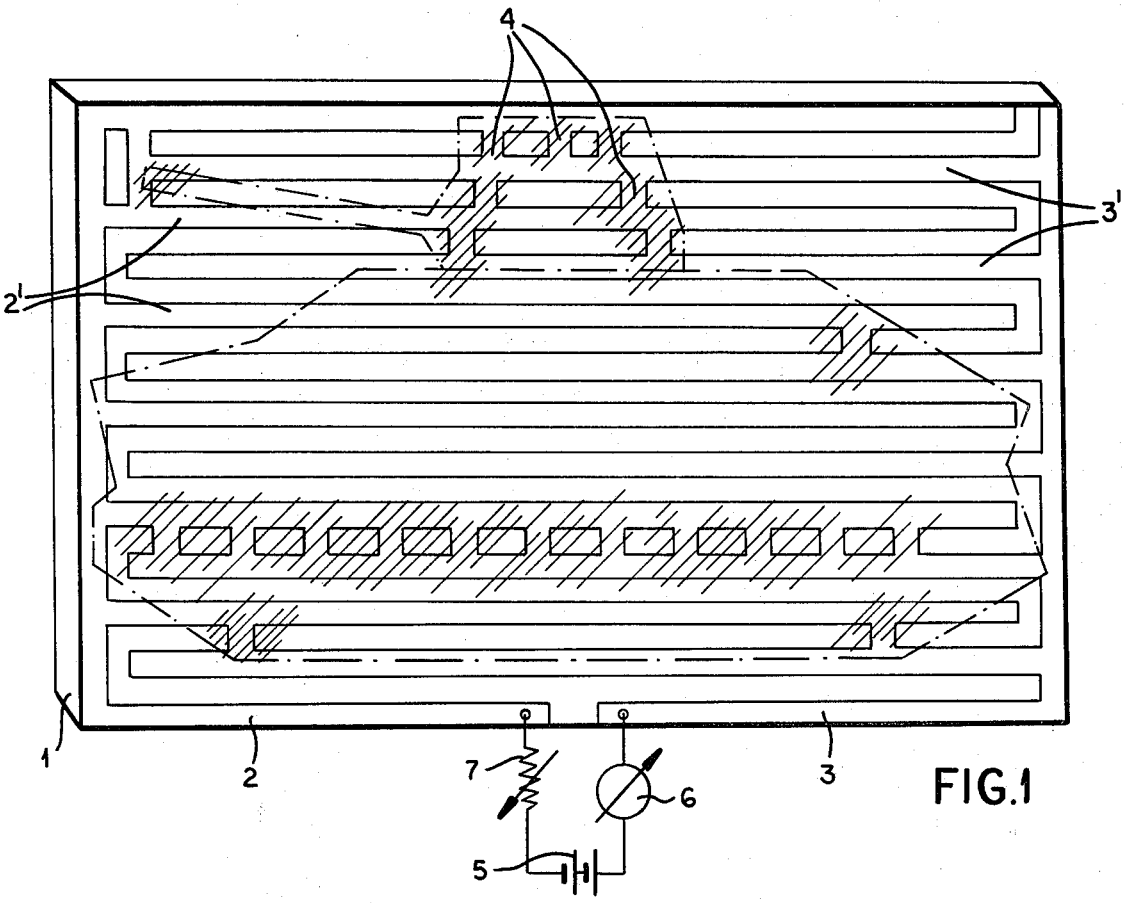
FIG. 1 shows a target member according to a first embodiment of my invention in a diagrammatic front view.

The device shown in FIG. 1 comprises an upright rectangular target member 1 carrying the silhouette of a tank. Selected localized areas of greater heat radiation have been indicated in FIG. 1 by hatching.

The illustrated front surface of member 1 carries two conductors 2 and 3 with branches forming interleaved arrays of horizontal strips 2', 3'. In order to obtain an adequately identifiable heat increase at the selected locations, patches 4 made from less conductive resistance material bridge adjoining strips 2' and 3'. By means of a d-c power supply 5, an ammeter 6 and a voltage regulator 7 the conductors 2 and 3 form a circuit for the energization of patches 4 which act as localized heat sources on being connected in parallel across the supply terminals.

The patches or bridges 4 and the conductors 2, 2' and 3, 3' can be metal foils, conductive varnishes or the like. The bridges 4 could also be webs or large-area coatings wider than the bullet holes, as already noted. As likewise mentioned above, a conductor portion damaged by a shot can be burned away by the overload current traversing same.

It is convenient to produce the circuitry of such a target member by screen printing or similar processes; the complete target can be covered with a protective film.

Figure 2:
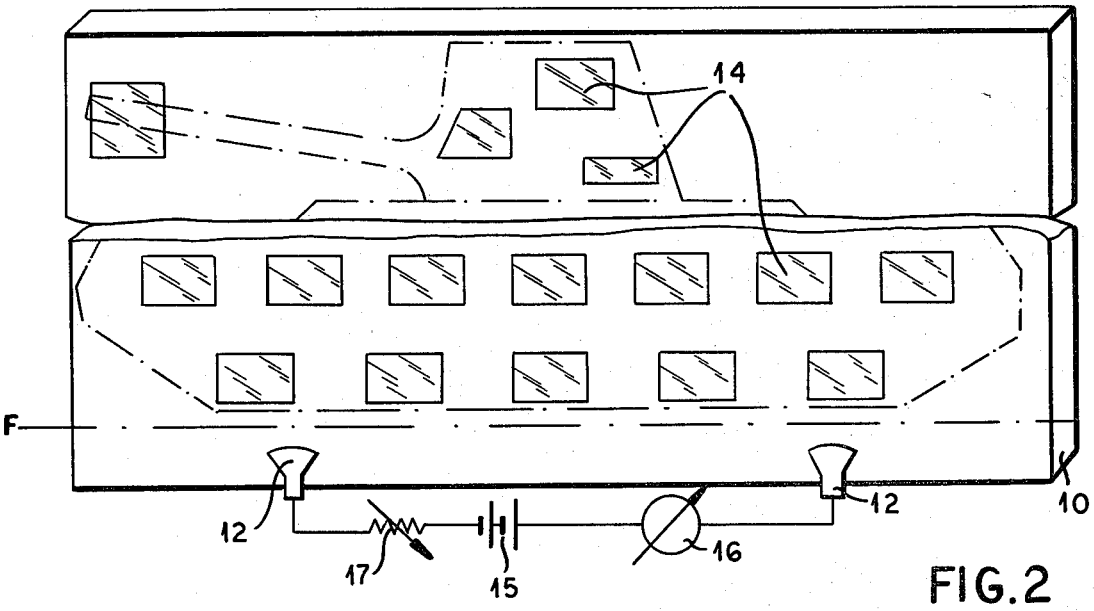
FIG. 2 shows another target member according to a second embodiment of my invention in a similarly diagrammatic front view.

In the embodiment of FIG. 2, the characteristic thermal-signature areas on the tank image are occupied by reflectors 14 which can be pierced by shots and are exposed to irradiation by heat rays from a plurality of infrared lamps 12 positioned in front of an upright target member 10. The heat-emitting zones 14 are made from a more strongly reflecting material than the rest of the target surface.

The infrared lamps 12 are connected in circuit with a power supply 15, an ammeter 16 and a voltage regulator 17, these components being all located beneath a firing line indicated at F.

I claim:

1. A device usable in firearm practice, comprising an upright target member having a front surface provided with a multiplicity of radiation-emitting areas simulating the thermal signature of an object to be shot at, said front surface being covered by two interleaved arrays of parallel conductor strips, said radiation-emitting areas being constituted by short patches of resistance material bridging adjacent conductor strips of said arrays, the conductor strips of said arrays being connected across a power supply for energizing said patches in parallel to make them act as localized heat sources.

2. A device as defined in claim 1 wherein said conductor strips and patches are part of a printed circuit.

3. A device as defined in claim 1 or 2, further comprising voltage-regulating means in series with said power supply.

* * * * *